US005442988A

United States Patent [19]

Mayo

[11] Patent Number: 5,442,988

[45] Date of Patent: Aug. 22, 1995

[54] NON-LOOSENING, KEYLESS DRUM TUNING DEVICE

[76] Inventor: Brett E. Mayo, 5424 Fox Hound La., Westerville, Ohio 43081

[21] Appl. No.: 320,358

[22] Filed: Oct. 11, 1994

[51] Int. Cl.[6] ..... G10D 13/02

[52] U.S. Cl. ..... 84/413

[58] Field of Search ..... 84/413, 411 R, 412, 84/418, 419, 420, 411 A

[56] References Cited

U.S. PATENT DOCUMENTS

| | | | |
|---|---|---|---|
| 4,154,136 | 5/1979 | McIntyre | 84/411 A |
| 4,206,681 | 6/1980 | Kluczynski et al. | 84/411 |
| 4,506,586 | 3/1985 | Brewer | 84/413 |
| 4,630,521 | 12/1986 | Alletto | 84/413 |
| 4,790,229 | 12/1988 | Hoshino | 84/413 |
| 4,870,883 | 10/1989 | Gauger | 84/413 |
| 4,928,566 | 5/1990 | Yanagisawa | 84/413 |
| 5,208,412 | 5/1993 | Hoshino | 84/413 |

*Primary Examiner*—Michael L. Gellner
*Assistant Examiner*—Cassandra Spyrou
*Attorney, Agent, or Firm*—John L. Gray

[57] ABSTRACT

A lug casing attached to the side of a drum containing a nonreversing gear which is attached to a threaded cylinder. The nonreversing gear is turned by a worm gear or a pinion gear which is connected to a knob that goes through the side of the lug casing. A T-lug is pulled into the threaded cylinder of the lug casing by the T-lug's accommodating threads. The T-lug fits into a rim on the perimeter of the drum applying tension to a very broad area of the drumhead that is fitted over the edges of a cylindrical drum shell.

3 Claims, 1 Drawing Sheet

Fig 1
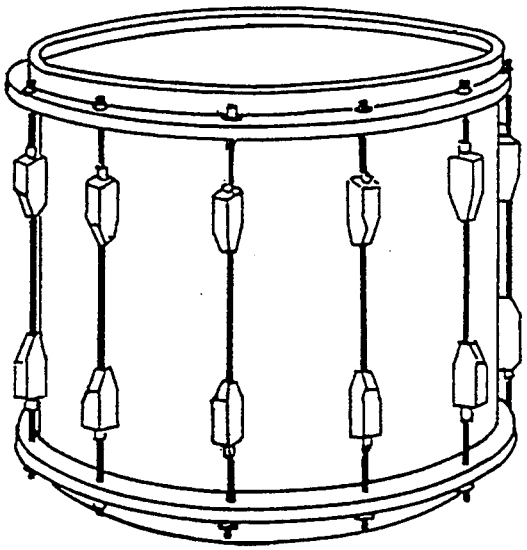
PRIOR ART
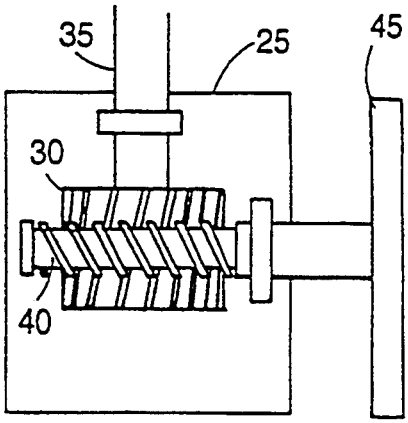
Fig 3
Fig 2
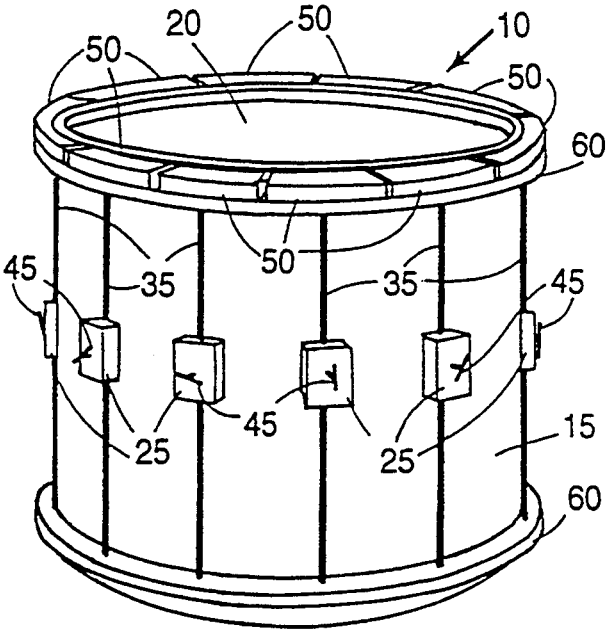
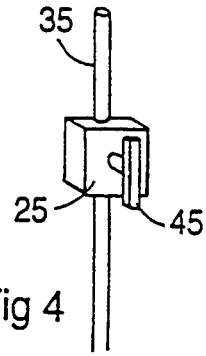
Fig 4
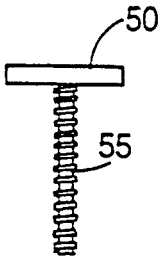
Fig 5

NON-LOOSENING, KEYLESS DRUM TUNING DEVICE

The present invention relates to an improved tightening device for applying tension to a drumhead.

Drums for percussion, such as bass drums, snare drums, etc., often comprise a cylindrical drum shell open at both ends, a pair of drumheads individually covering two opposite end openings of the drum shell, and means for applying tension to the drumhead to hold them in place. The method for applying tension usually consists of hoops along the respective edges of the drumheads. Bolts are inserted individually in holes in the hoops and metal lugs having nuts into which the bolts are screwed. The lugs are fixed to the drum by means of screws.

The bolts that secure the drumhead to the drum body also allow an individual to adjust the tension of the drumhead to tune it. However, several problems exist with this old method. First, an unattached key is needed to adjust the bolts for tuning the drum. Second, repeated hits to the drumhead causes the bolts to loosen, hence taking the drum out of its desired tune. Finally, the bolts when tightened applies pressure to a very small point on the drum rim creating a narrow line of tension on the drumhead between opposition bolts, thus creating a small "sweetspot" (the area on the drumhead that is in the best tune) on the drumhead.

SUMMARY OF THE INVENTION

The present invention allows a person to tune a drum by turning a knob attached to each lug casing on the drum. The drumheads are held into place by T-shaped lugs or T-lugs which are pulled into the lug casing when the knob is turned. The T-lugs apply tension to the drumhead in a broader, more even manner because of its "T" shape. Once the drum is turned to the desired pitch, the individual T-lugs will not loosen themselves from repetitive hits and vibrations on or within the drum because of the non-reversing gear.

Accordingly, it is an object of this invention to provide a drumhead tightening device that will not loosen from repeated hits or vibrations.

It is another object of this invention to eliminate the need for an unattached tuning key to adjust the tune of the drum.

It is also an object of this invention to create tension on the drumhead in wide bands between opposing lug casings, producing even tuning and an extremely large "sweetspot".

These, together with other objects and advantages of the invention will become more readily apparent to those skilled in the art when the following general statements and descriptions are read in the light of the appended drawings.

BRIEF DESCRIPTION OF THE DRAWINGS

FIG. 1 is a perspective view of a drum with a prior art tightening device.

FIG. 2 is a perspective view of a drum provided with the improved tightening device.

FIG. 3 is a sectional view of the non-reversing gear that is attached to the lug casing.

FIG. 4 is a perspective view of the lug casing with a threaded cylinder end and knob.

FIG. 5 is a perspective view of the T-shaped lug or T-lug.

DETAILED DESCRIPTION OF THE PREFERRED EMBODIMENT

As shown in FIG. 2, the drum 10 is a cylindrical drum body 15 with opposite top and bottom ends, a top drum head 20 and a bottom drumhead (not shown), lug casings 25—25 which are attached to the side of the drum body 15. The lug casings 25—25 contain a nonreversible gear 30 which is attached to a threaded cylinder end 35—35. The nonreversible gear 30 is turned by either a worm gear 40 or a pinion gear (not shown) which is attached to a knob 45—45 that goes through the side of the lug casing. The nonreversible gear 30 will control one T-shaped lug or T-lug 50. A T-shaped lug or T-lug 50 is pulled into the threaded cylinder end 35—35 because of the T-lugs' 50—50 accommodating threads 55. The T-lugs 50—50 will be seated into a rim 60 on the perimeter of the drum body 15, thus applying uniform tension to the drumhead 20 that is fitted over the edges of the drum body 15.

FIG. 4 is a perspective view of the lug casing 25—25, which includes the threaded cylinder end 35—35, the nonreversible gear 30 (not shown in FIG. 4), and the knob 45—45 that goes through the side of the lug casing.

FIG. 5 is a perspective view of the T-lug 50 with its accommodating threads 55.

While this invention has been described in its preferred embodiment, it is to be appreciated that variations therefrom may be made without departing from the true scope and spirit of the invention.

What is claimed is:

1. A tightening device for applying tension to a drumhead, comprising:

a drum having an open end over which a drumhead is to be placed;

said drum having a rim on the perimeter for receiving a drumhead;

a plurality of lug casings with threaded cylinder ends which are placed on sides of said drum;

a nonreversing gear that is attached to each said lug casing;

a plurality of T-shaped lugs with accommodating threads for the threaded cylinder ends;

said T-shaped lugs shaped to fit within the drum rim and hold said drumhead in place by providing tension;

means for turning said nonreversing gear thereby pulling the T-shaped lug into the threaded cylinder end.

2. The tightening device of claim 1, wherein said means for turning said nonreversing gear is a worm gear attached to a knob that extends from the side of the lug casing.

3. The tightening device of claim 1, wherein said means for turning said nonreversing gear is a pinion gear attached to a knob that extends from the side of the lug casing.

* * * * *